US006590174B2

(12) United States Patent
Zysnarski et al.

(10) Patent No.: US 6,590,174 B2
(45) Date of Patent: Jul. 8, 2003

(54) SWITCH ASSEMBLY HAVING DIFFUSED ILLUMINATION

(75) Inventors: Adam Zysnarski, Sterling Heights, IL (US); Shadi Mere, Ypsilanti, MI (US); Todd Bagdonas, Allen Park, IL (US)

(73) Assignee: Visteon Global Technologies, Inc., Dearborn ( * ) Notice: Subject to any disclaimer, the term of this patent is extended or adjusted under 35 U.S.C. 154(b) by 0 days.

(21) Appl. No.: 09/823,490

(22) Filed: Mar. 30, 2001

(65) Prior Publication Data

US 2002/0139651 A1 Oct. 3, 2002

(51) Int. Cl.[7] ..... H01H 9/00
(52) U.S. Cl. ..... 200/310; 200/5 R; 200/311
(58) Field of Search ..... 200/310, 311, 200/312, 313, 314, 317, 5 R, 520, 329, 341

(56) References Cited

U.S. PATENT DOCUMENTS 5,039,832 A 8/1991 Polacek et al. ..... 200/317
5,093,764 A 3/1992 Hasegawa et al. ..... 362/29
5,280,145 A * 1/1994 Mosier et al. ..... 200/313
5,288,957 A 2/1994 Swaybill ..... 200/317
5,308,943 A 5/1994 Screven et al. ..... 200/521
5,572,107 A * 11/1996 Nakano et al. ..... 200/314
5,636,729 A * 6/1997 Wiciel ..... 200/181
5,813,519 A * 9/1998 Gotoh ..... 200/313
5,861,589 A * 1/1999 Sato et al. ..... 200/5 R
6,025,566 A * 2/2000 Chauvet et al. ..... 200/314

* cited by examiner

*Primary Examiner*—Ann Mai
*Assistant Examiner*—Kyung S. Lee
(74) *Attorney, Agent, or Firm*—Brinks Hofer Gilson & Lione

(57) ABSTRACT

A switch assembly comprises a substrate and a multi-way switch mounted on the substrate. A knob is connected to the multi-way switch and has a perimeter. The knob is used for controlling a position (e.g., a shaft position) or corresponding electrical state of the multi-way switch. At least one light source is associated with the substrate. A light diffuser is located at least partially in an optical path between one or more of the light sources and a region about the perimeter of the knob.

23 Claims, 5 Drawing Sheets

SWITCH ASSEMBLY HAVING DIFFUSED ILLUMINATION

FIELD OF THE INVENTION

The present invention relates to a switch assembly having diffused illumination.

BACKGROUND

An electronic device may use an illuminated switch assembly to permit a user to identify a switch during darkness or conditions of low ambient light. In one prior art configuration, an illuminated switch assembly may include a knob that has a transparent or translucent region that represents a symbol or a graphical form to provide a recognizable indicator of the knob during conditions of low ambient light. For example, the transparent or translucent region of the knob may be formed by a laser-etching process. However, internal the light source that is supposed to be incident upon the translucent region may be partially obscured or blocked by a shaft, which is connected to the knob. Accordingly, an illuminated form or symbol on a knob may not be uniformly illuminated because of the shadow or dimness created by the obstruction of the shaft with respect to the light source. Another problem with back-lighting a knob is that the distance between the illuminated face of the knob and the light source may be so great as to reduce the brightness of the illuminated symbol or graphical form so as to make the symbol or form illegible or otherwise difficult for a user to interpret.

In another prior art configuration, the switch assembly may be associated with a light pipe or light tunnel to provide ring of illumination around the base of a knob. The light pipe may not provide uniformly distributed light, unless multiple light sources are used. The light-pipe configuration tends to leave the shaft associated with the knob exposed to provide an adequate illumination around the base of the knob. An exposed shaft may detract from the aesthetic appearance of the switch assembly or the associated electronic device that uses the switch assembly. Moreover, the exposed shaft of the switch assembly may allow foreign particles, such as dirt or debris, to become lodged in the interior of the switch assembly or to interfere with the proper operation of an electronic device associated with the switch assembly. Reliable operation of the electronic device on the switch assembly may be compromised by electrically conductive or nonconductive particles entering about the region of the shaft. Conductive particles may cause electrical shorts for the electronic device, whereas nonconductive particles may interfere with the operation of electrical contacts, for example. Thus, a need exists for a switch assembly that is illuminated in a generally uniform manner to provide a reliable and intelligible identifier of the switch without sacrificing compactness. Further, a need exists for switch assembly that hides a shaft of the switch for enhanced aesthetic appearance or protect the reliable operation of the switch and its associated electronics.

SUMMARY

In accordance with the invention, the switch assembly comprises a substrate and a multi-way switch mounted on the substrate. A knob is connected to the multi-way switch and has a perimeter. The knob is used for controlling a position (e.g., a shaft position) or corresponding electrical state of the multi-way switch. At least one light source is associated with the substrate. A light diffuser is located at least partially in an optical path between one or more of the light sources and a region about the perimeter of the knob.

The switch assembly provides uniformly dispersed light and protects an interior of the switch assembly from the ingress of foreign particles. The switch assembly is well-suited for hiding the shaft of a multi-way switch from a user even at a maximum angular tilt of the shaft of the multi-way switch.

DETAILED DESCRIPTION OF THE INVENTION

Figure 1:
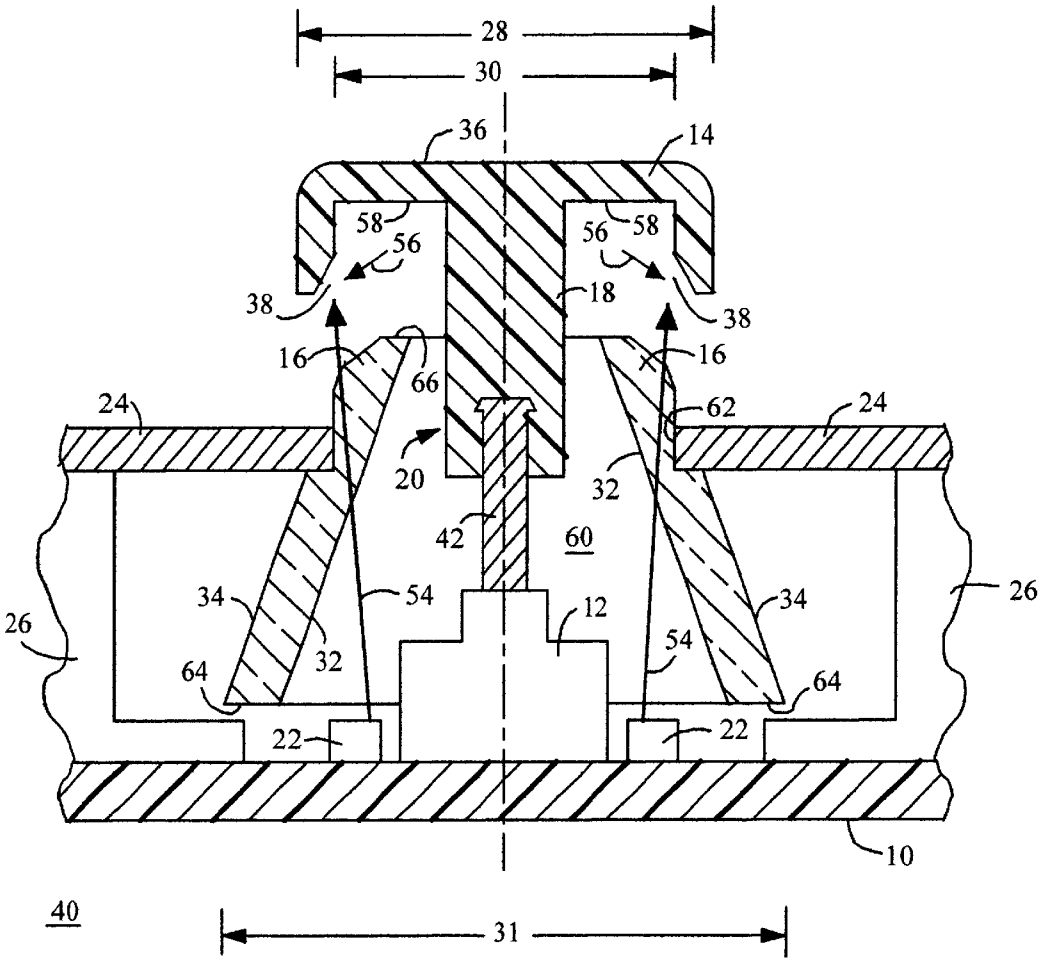
FIG. 1 is a cross-sectional view of a switch assembly in accordance with the invention.

In accordance with the invention, a switch assembly 40 includes a substrate 10 and a multi-way switch 12 mounted to the substrate 10. A knob 14 is mounted to the multi-way switch 12. The knob 14 controls the position of the multi-way switch 12 and has a perimeter 28. At least one light source 22 is associated with the substrate 10. A light diffuser 16 is positioned at least partially in an optical path between the at least one light source 22 in a region within or bounded by the perimeter 28 of a knob 14. The interior region 60 of the switch assembly 40 includes at least a volume within the interior of the light diffuser 14. In one embodiment, the interior region 60 defines a volume bounded by an interior of the knob 14, the light diffuser 16, and the substrate 10.

The substrate 10 may comprise a circuit board. For example, the substrate 10 may comprise a ceramic or a polymeric circuit board (e.g., FR4) that has conductive traces (not shown). In one embodiment, two light sources 22 are associated with the substrate 10. Each of the light sources 22 may comprise one or more of the following: a light-emitting diode, a lamp, an illuminating termination of a fiber optic cable, an incandescent lamp, and any other suitable light source 22. If two light sources 22 are used, the light sources 22 may be arranged on opposite sides of a multi-way switch 12 mounted on the substrate 10.

The bezel 24 is spaced apart from the substrate 10. The bezel 24 may be a generally planer member that is spaced apart from the substrate 10 by a spacer 26 or is supported independently of the substrate 10. The bezel 24 has an opening 62 for receiving the light diffuser 16. Although the opening in FIG. 1 is generally circular, in an alternate embodiment the opening may have another geometric shape.

The light diffuser 16 may have a generally hollow, semi-conical form. For example, the light diffuser 16 may comprise a polymeric frustum. One end 64 of light diffuser 16 has a first diameter 31 greater than a second diameter 30 of an opposite end 66 of the light diffuser 16 to accommodate movement of the knob 14 in a plurality of possible positions (e.g., angular shaft positions) of the knob 14.

The diffusive properties of the light diffuser 16 may be attributed to various techniques. Under a first technique, the light diffuser 16 is composed of a diffusive polymeric matrix. The diffusive polymeric matrix comprises a light-transmissive binder and a filler with reflective properties. For example, the diffusive polymeric matrix may comprise: (1) polycarbonate or acrylate as the binder and (2) titanium dioxide and/or hollow glass micro-spheres as the filler. A glass micro-sphere scatters light through reflections attained by a differential in the index of refraction of a hollow core (e.g., air pocket) of the micro-sphere with respect to the body of the micro-sphere.

Under a second technique, an interior surface 32, an exterior surface 34, or both surfaces of the diffuser 16 may be sufficiently rough to scatter or diffuse light directly or indirectly incident upon the light diffuser 16 from one or more light sources 22. Accordingly, the light diffuser 16 may be composed of a diffusive polymeric material of the first technique or a transparent or translucent polymer without a reflective filler. The interior surface 32 and the exterior surface 34 may be roughened, ridged, bumpy or otherwise jagged to produce the desired diffusion of the light from one or more of the light sources 22.

The light diffuser 16 may have a step for engaging the bezel 24 to promote alignment of the light diffuser 16 with respect to the bezel 24. The light diffuser 16 is arranged to intercept light emitted by at least one of the light sources 22 prior to the light exiting from an interior region 60 of the switch assembly 40 to an exterior of the switch assembly 40 via the light diffuser 16 and the gap 38. The light diffuser 16 diffuses or scatters the light emitted by at least one light source 22 to provide an even dispersion or distribution of light about a perimeter 28 of the knob 14 in a vicinity of the gap 38. The light diffuser 16 is tapered to support freedom of movement of the shaft 42 while hiding the shaft 42 from a user of the switch assembly 40. The shaft 42 of the switch assembly 40 is hidden from a user even at the maximum angular tilt of the shaft 42.

In one embodiment, the light diffuser 16 engages the bezel 24 in a sufficiently tight manner or is sealed with a sealant or adhesive so as to form a barrier against the entry of foreign particles into the interior region 60 of the switch assembly 40. The foreign particles may include dust, dirt, conductive particles or other foreign matter that may interfere with the proper operation of the switch assembly 40 or the underlying electronic device that the switch assembly 40 supports. For example, dirt that collects near one or more light sources 22 may attenuate or detract from the intensity (e.g., brightness) of the illumination of the switch assembly. Accordingly, the reliability of the switch assembly 40 and the aesthetic appearance of the switch assembly 40 is enhanced by the light diffuser 16 in cooperation with other components of the switch assembly 40 to provide an aesthetically-pleasing and reliable switch assembly 40. Although the knob 14 and the light diffuser 16 represent separate components of the switch assembly 40, the knob 14 and the light diffuser 16 may appear to be one piece to a user.

The knob 14 is connected to the multi-way switch 12 via a fastening mechanism 20. In general, the fastening mechanism 20 may comprise one or more of the following: a threaded collar, a snap-fit joint, an interlocking joint, an adhesive, a press-fit joint, a collar having threaded fastener, and any other suitable fastening arrangement. The knob 14 has a stem 18 extending from a central region of the knob 14. The stem 18 may extend from the central region in a coaxial manner with respect to a perimeter 28 of the knob 14. The stem 18 may form one end of the fastening mechanism 20, while the shaft 42 of the multi-way switch 12 may form another end of the fastening mechanism 20. As shown in FIG. 1, the fastening mechanism 20 may be characterized as a snap-fit joint, where the stem 18 of the knob 14 elastically deforms to engage or release the shaft 42 of the multi-way switch 12.

A contact portion 36 of the knob 14 is located on an exterior of the switch assembly 40. The contact portion 36 may be shaped like a button or disk. The knob 14 is configured to maintain a physical gap 38 between the diffuser 16 and the knob 14 and a optical path (e.g., a diffusive optical path) between the bezel 24 and the knob 14. The dimensions and/or shape of the gap 38 may change as the contact portion 36 of the button or knob 14 is pressed in different areas of the contact portion 36 by a user. The gap 38 may support optical transmission of light or an optical path between the light source 22 associated with the interior region 60 of the switch assembly 40 and a user located at an exterior of the switch assembly 40.

The switch assembly 40 may be used to control a cursor on a display of an electronic device or to control alphanumeric characters or other symbols on a display. The switch assembly 40 may support selection of items or symbols from a menu or other actions of a user interface of an electronic device. The multi-way switch 12 may include one or more of the following: a four-way switch, an eight-way switch, a sixteen-way switch, a thirty-two way switch, and a joystick. In the context of a multi-way switch 12, a "way" refers to a possible position (e.g., an angular position) of the switch. Each position of the multi-way switch 12 represents a unique or distinguishable mechanical position of the switch that provides a corresponding different electrical output or supports a corresponding different electrical output, which may be used by an electronic device.

Figure 2:
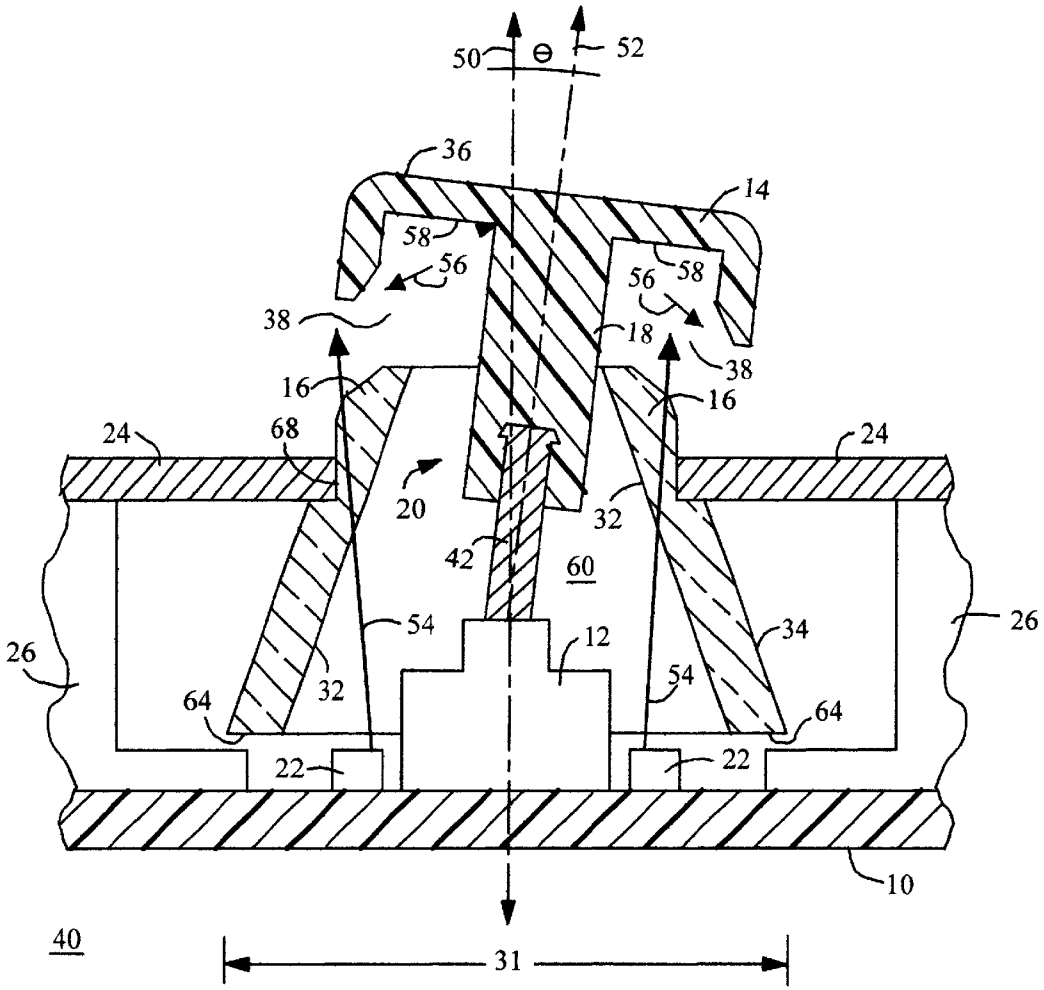
FIG. 2 is a cross-sectional view of a switch assembly in which a knob is tilted a maximum angle with respect to a normal axis.

As shown in FIG. 2, the positions or ways of the switch may be defined by an angle ($\theta$) or a compound angle in three dimensions that the shaft axis 52 of the switch makes with respect to a normal axis 50 extending perpendicularly from a surface of the substrate 10. The multi-way switch 12 may have a shaft 42 that has a maximum angle ($\theta_{max}$) with respect to the normal axis 50. The knob perimeter 28, knob height above the bezel 24, and skirt (formed by the combination of the bezel 24 and diffuser 16) may be designed to keep the knob 14 from touching the skirt at the maximum angle.

The multi-way switch 12 may have a maximum angle of the shaft 42 with respect to the normal axis 50. The light diffuser 16 has a shape and size commensurate with the maximum angle to prevent the shaft 42 from touching the light diffuser 16 at the maximum angle. Where the shaft 42 is prevented from touching the light diffuser 16, the operation of the multi-way switch 12 or movement of the shaft 42 is not interfered with or detracted from in any manner. If the range of movement of the shaft 42 of the multi-way switch 12 were restricted from reaching the maximum angle ($\theta_{max}$), the output of the multi-way switch 12 may not support all the requisite states for proper operation of the underlying electronic device.

Each light source 22 emits light, some of which traverses a light path or optical path from the light source 22 to a gap 38 about a periphery of the knob 14. The light that emanates from the gap 38 about the knob 14 and the affiliated light path may comprise contributions (e.g., rays) from one or more of the following: a generally direct light component 54, a reflective light component 56, and a refractive light component (not shown). The diffuser 34 may refract light incident upon the interior surface 32 at certain angles because of the different indices of refraction of the light diffuser 16 and the surrounding air in the interior region 60, in accordance with Snell's law, as is well known to those skilled in the optical arts. When light leaves the diffuser 16 and enters the exterior, the light may be refracted again. The light diffuser 16 tends to scatter light incident upon the diffuser 16 in addition to refracting it. An interior surface 58 of the knob 14 may reflect light, which ends up being transmitted through the gap 38. In one embodiment, the interior surface 58 may be white or coated with a reflective material (e.g., a metallic material) to maximize the reflective component. Accordingly, maximizing the magnitude of the reflective component 56 may increase the intensity of the light emitted from the gap 38 so long as the light waves combine in a predominately constructive manner.

The geometrical relationship of the light diffuser 16 and the knob 14 along with the light source 22 creates an effect as if the knob 14 is floating on light. The effect of the knob 14 floating on light may be referred to as the lampshade effect. Uniform illumination may be attained with as few as two light sources 22 because of the diffusive material and/or surface topology of the light diffuser 16 coupled with the geometric relationship of the components of the switch assembly 40. The wall or walls of the light diffuser 16 generally surround the light sources 22 and the interior region of the switch assembly 40.

In one embodiment, the knob diameter, the knob height above the bezel 24 and the skirt geometry were designed to achieve minimum knob height and maximum diameter of the knob 14, while keeping the knob 14 from touching the bezel 24 or diffuser 16 at maximum angular displacement ($\theta_{max}$) or keeping the shaft 42 from hitting the light diffuser 16 at the maximum angle of rotation. The maximum angle of rotation for a eight-way switch may be approximately thirteen degrees, although in alternate embodiments, other maximum angular rotations may apply.

Figure 3:
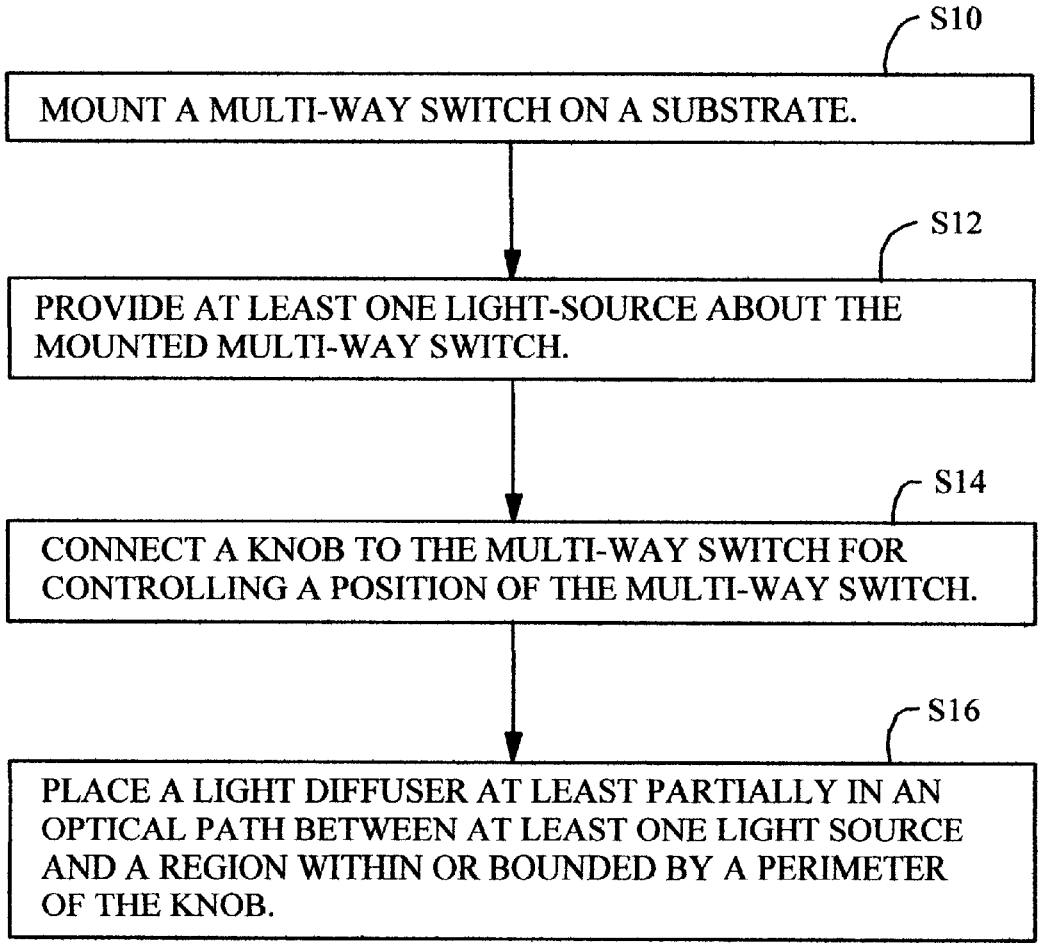
FIG. 3 is a flowchart of a method of arranging a switch assembly in accordance with the invention.

FIG. 3 is a flowchart of a method for arranging a switch assembly 40 in accordance with the invention. The method of FIG. 3 starts in step S10.

In step S10, the multi-way switch 12 is mounted on the substrate 10. For example, the multi-way switch 12 may be electrically connected to circuit traces of a circuit board as the substrate 10. The multi-way switch 12 may be both mechanically and electrically connected to the portions (e.g., conductive traces) of the substrate 10 in step S10.

In step S12, at least one light source 22 is provided about the mounted multi-way switch 12. The light source 22 may be located on approximately opposite sides of the multi-way switch 12 such that when viewed from a top view of the substrate 10, which corresponds to the side view of FIG. 1, the light sources 22 are separated by approximately 180°. Nevertheless, the light sources 22 may be separated by any suitable angular separation (as viewed from the top view) that provides uniform illumination of the switch assembly 40 after operation of the light diffuser 16.

In step S14, the knob 14 is connected to the multi-way switch 12 for controlling a position of the multi-way switch 12. The knob 14 may allow a shaft 42 of the multi-way switch 12 to change its angular position from a normal position coincident with the normal axis 50 (FIG. 2) to a position of maximum angular tilt of the shaft axis 52 in one or more directions. Each direction may represent a different logical state that may be used to control a display of an electronic device supported by the switch assembly 40.

The light diffuser 16 is placed at least partially in an optical path between at least one light source 22 in a region within or bounded by a perimeter 28 of the knob 14. In one embodiment, the light diffuser 16 provides a boundary between the interior region 60 of the switch assembly 40 and an exterior region of the switch assembly 40. The perimeter 28 of the knob 14 may represent a circumference of the knob 14, a periphery of the knob 14, or a perimeter of another geometric shape.

Step S12 may be carried out in accordance with various alternative techniques. In accordance with a first technique, step 312 may include placing a semi-conical member as the light diffuser 16. In accordance with another technique, the step S12 may include placing a polymeric frustum as the light diffuser 16.

Step S16 may be followed by additional step in which a bezel 24 is provided as a support between the substrate and the knob 14. The bezel 24 has an opening for receiving the light diffuser 16. The light diffuser 16 may have a step 68 for engaging the bezel 24 to promote alignment of the light diffuser 16 with respect to the bezel 24. The light is emitted or may be emitted via the gap 38 between the knob 14 and the bezel 24 associated with the knob 14. The light source 22 may be illuminated following steps S10 through S16 so as to emit light about a perimeter 28 of a knob 14 through the light diffuser 16.

Figure 4:
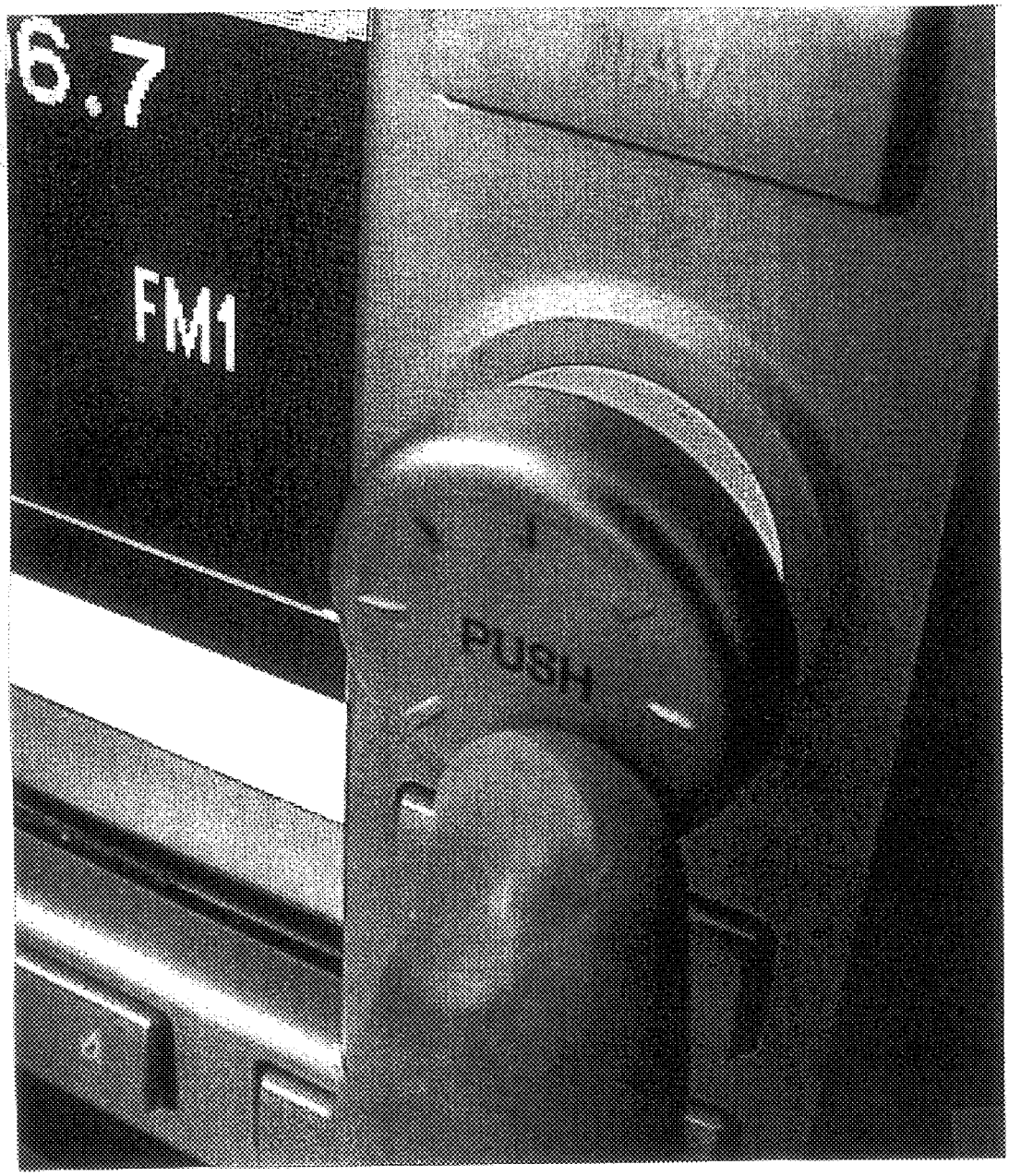
FIG. 4 and FIG. 5 are reproductions of black-and-white photographs that illustrate an exemplary embodiment of an illuminated switch assembly in accordance with the invention.
Figure 5:
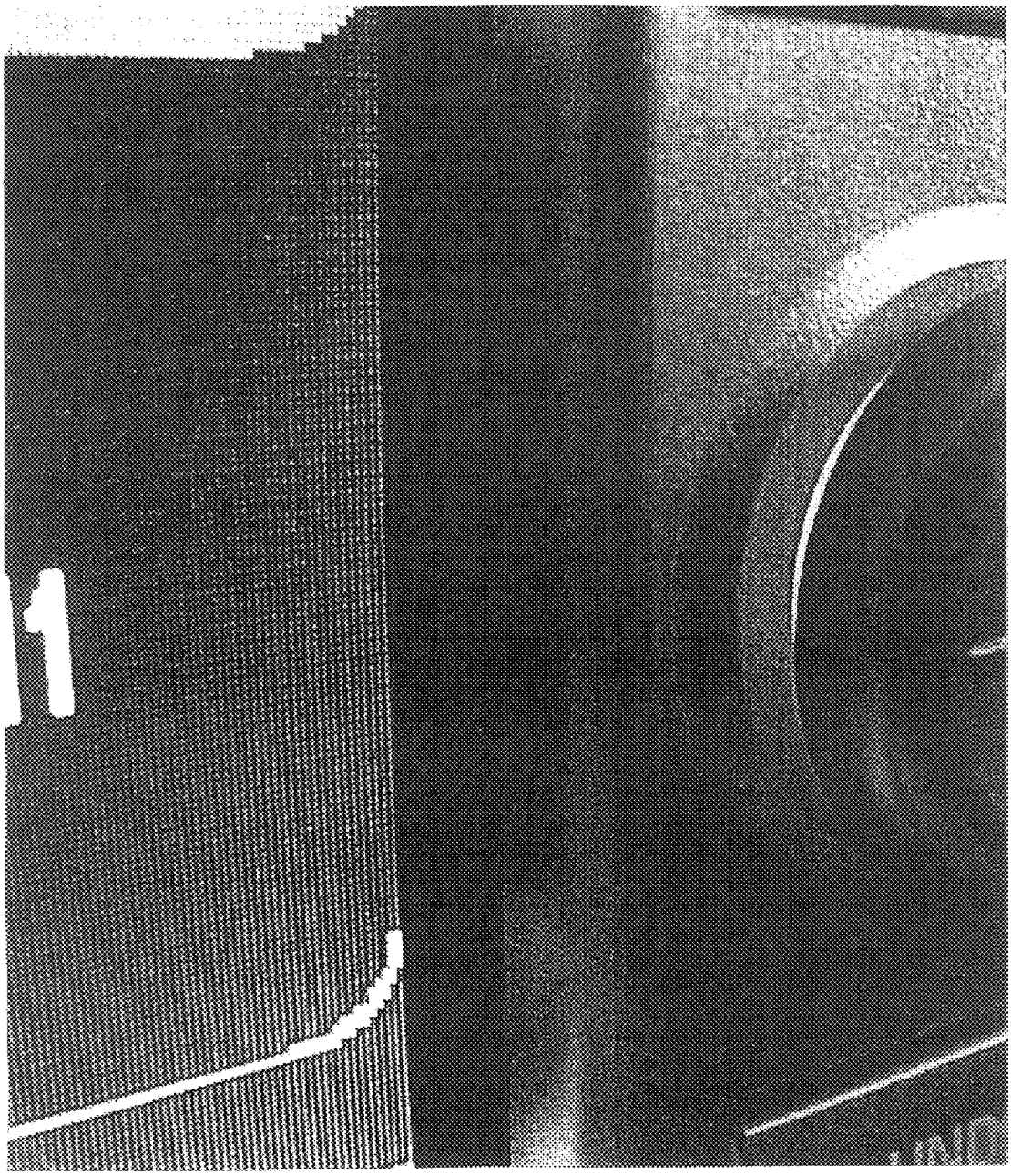

FIG. 4 and FIG. 5 illustrate the resultant aesthetic appearance that may be provided by one embodiment of the switch assembly 40 in accordance with reproductions of a black-and-white photographs. In FIG. 4, a face of the knob 14 is designated with the word "push". The face of the knob 14 or contact area 36 has radial protrusions which are separated by approximately 45° from each other to facilitate a user's manipulation to attain multiple distinct positions of the knob 14. As shown in FIG. 4, for example, the user is pressing the contact region to place the knob 14 in a position associated with the six-o'clock position of the radial protrusion on the contact area 36. The upper region of the knob 14 is tilted outward from the bezel 24 and exposes a generally secant-shaped region of illumination. The secant-shaped region of illumination supports an aesthetic appearance of the switch assembly 40 in which the knob 14 appears to be floating over the bezel 24 and suggests the illusion that the knob 14 is somehow supported by beams of light.

FIG. 5 shows a reproduction of a black-and-white photograph of the switch from another view distinct from the view of FIG. 4. The view of FIG. 5 shows a small illuminated region where it is clear the shaft 42 of the switch or the stem 18 of the knob 14 is not visible to a user.

Accordingly, the switch assembly 40 provides an illuminated knob 14 that appears as if it is floating on light. The shaft 42 of the knob 14 is hidden even at the maximum angular tilt. The switch assembly 40 takes up minimum space and uses only as few as two light sources 22 while providing an ergonomic contact area 36 for a user in a well-lit and recognizable contact area 36. The switch assembly may be incorporated into an electronics device associated with a vehicle to promote ready recognition of the switch assembly 40 by a user under conditions of low ambient light (e.g., darkness or night time).

The foregoing description of the switch assembly and method describes several illustrative examples of the invention. Modifications, alternative arrangements, and variations of these illustrative examples are possible and may fall within the scope of the invention. Accordingly, the claims should be accorded the reasonably broadest interpretation, which is consistent with the specification disclosed herein, and not unduly limited by aspects of the preferred embodiments disclosed herein.

The following is claimed:

1. A switch assembly comprising:

a substrate;

a multi-way switch mounted to the substrate;

a knob for controlling a position of the multi-way switch and having a perimeter, at least one light-source associated with the substrate, and a light diffuser unattached to the knob and located at least partially in an optical path between the at least one light source and a region proximate the perimeter of the knob so that light from the at least one light-source enters the light diffuser and leaves the light diffuser near the perimeter of the knob so that the light is emitted outside of the perimeter.

2. The assembly according to claim 1 wherein the light diffuser has a semi-conical form.

3. The assembly according to claim 1 wherein the light diffuser comprises a polymeric frustum.

4. The assembly according to claim 1 wherein one end of the light diffuser has a diameter greater than an opposite end of the light diffuser to accommodate movement of the knob in a plurality of possible positions of the knob.

5. The assembly according to claim 1 wherein the substrate comprises a circuit board of an electronic device controllable by the multi-way switch.

6. The assembly according to claim 1 wherein the multi-way switch comprises one of the following: a four-way switch, an eight-way switch, a sixteen-way switch, a thirty-two way switch, and a joystick.

7. The assembly according to claim 1 wherein the at least one light source comprises one of the following: a light emitting diode, a lamp, and a light-emitting termination of a fiber optic transmission line.

8. The assembly according to claim 1 further comprising:

a bezel between the substrate and the knob, the bezel having an opening for receiving the light diffuser.

9. The assembly according to claim 8 wherein the light diffuser has a step for engaging the bezel to promote alignment of the light diffuser with respect to the bezel.

10. The assembly according to claim 8 wherein the multi-way switch comprises a shaft having a maximum angle with respect to a normal angle to a surface of the substrate, the knob perimeter, knob height, and skirt of the bezel being designed to keep the knob from touching the bezel at the maximum angle.

11. The assembly according to claim 1 wherein the multi-way switch comprises a shaft having a maximum angle with respect to a normal angle to a surface of the substrate, light diffuser having a shape and size commensurate with the maximum angle to prevent the shaft from touching the light diffuser at the maximum angle.

12. The assembly according to claim 1 wherein the light diffuser is composed of a diffusive polymeric matrix comprising a light-transmissive binder and particles of reflective filler.

13. The assembly according to claim 12 wherein the light diffuser is composed of polycarbonate as the binder and titanium dioxide particles as the reflective filler.

14. A method of arranging a switch assembly, the method comprising:

mounting a multi-way switch mounted on a substrate, providing at least one light-source about the mounted multi-way switch, connecting a knob to the multi-way switch for controlling a position of the multi-way switch; and placing a light diffuser unattached to the knob at least partially in an optical path between the at least one light source and a region proximate the perimeter of the knob so that light from the at least one light-source enters the light diffuser and leaves the light diffuser near a perimeter of the knob so that the light is emitted outside of the perimeter.

15. The method according to claim 14 wherein the placing step comprises placing a semi-conical light diffuser as the light diffuser.

16. The method according to claim 14 wherein the placing step comprises placing a polymeric frustum as the light diffuser.

17. The method according to claim 14 wherein one end of the light diffuser has a diameter greater than an opposite end of the light diffuser to accommodate movement of the knob in a plurality of possible positions of the knob.

18. The method according to claim 14 further comprising:

providing a bezel between the circuit board and the knob, the bezel having an opening for receiving the light diffuser.

19. The method according to claim 18 further comprising providing the light diffuser with a step for engaging the bezel to promote alignment of the light diffuser with respect to the bezel.

20. The method according to claim 18 wherein the multi-way switch comprises a shaft having a maximum angle with respect to a normal angle to a surface of the substrate, the knob perimeter, knob height, and skirt of the bezel being designed to keep the knob from touching the bezel at the maximum angle.

21. The method according to claim 14 wherein the multi-way switch comprises a shaft having a maximum angle with respect to a normal angle to a surface of the substrate, light diffuser having a shape and size commensurate with the maximum angle to prevent the shaft from touching the light diffuser at the maximum angle 22. The method according to claim 14 further comprising illuminating the light source so as to emit light about a perimeter of the knob through the light diffuser.

23. The method according to claim 22 wherein the light is emitted via a gap region between the knob and a bezel associated with the knob.

* * * * *